US010622168B2

(12) United States Patent
Wu et al.

(10) Patent No.: US 10,622,168 B2
(45) Date of Patent: Apr. 14, 2020

(54) LOCKING STRUCTURE OF SWITCH DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wen-Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 63 days.

(21) Appl. No.: 15/802,687

(22) Filed: Nov. 3, 2017

(65) Prior Publication Data

US 2018/0130617 A1 May 10, 2018

(30) Foreign Application Priority Data

Nov. 7, 2016 (TW) ..... 105136118 A

(51) Int. Cl.

| | |
|---|---|
| ***H01H 9/08*** | (2006.01) |
| ***H01H 9/28*** | (2006.01) |
| ***H01H 19/04*** | (2006.01) |
| ***H01H 13/04*** | (2006.01) |
| ***H01H 1/52*** | (2006.01) |

(52) U.S. Cl.

CPC ..... *H01H 9/285* (2013.01); *H01H 1/52* (2013.01); *H01H 9/08* (2013.01); *H01H 13/04* (2013.01); *H01H 19/04* (2013.01)

(58) Field of Classification Search

CPC ..... H01H 1/52; H01H 13/04; H01H 19/04; H01H 19/605; H01H 9/08; H01H 9/285; H01H 9/20; H01H 9/22; H01H 9/223; G05G 5/06; G05G 5/08

See application file for complete search history.

(56) References Cited

FOREIGN PATENT DOCUMENTS

CN 2014 2019 5870 * 12/2014 ..... H01H 19/14

* cited by examiner

*Primary Examiner* — Vanessa Girardi

(74) *Attorney, Agent, or Firm* — Rosenberg, Klein & Lee

(57) ABSTRACT

A locking structure of switch device includes a connection seat formed with a main body assembling hole. An arm protrudes from the connection seat. A restriction section is formed on the arm. A shift body is assembled on the connection seat and movable between a first position and a second position. The shift body has a shift section aligned with the arm in the second position. A lever member is disposed on the shift section. Two ends of the lever member are respectively formed with a ridge section and a push/press section. When the shift body moves from the first position to the second position, the ridge section passes over the restriction section into a locked state. When pressing the push/press section, the ridge section is driven by way of leverage to backward pass over the restriction section into an unlocked state.

29 Claims, 6 Drawing Sheets

LOCKING STRUCTURE OF SWITCH DEVICE

BACKGROUND OF THE INVENTION

1. Field of the Invention

The present invention relates generally to a locking structure of switch device, and more particularly to a locking structure of switch device for installing/uninstalling the operation section main body and the wire connection module. The locking structure of the switch device can be operated with less strength. In addition, the entire structure of the locking structure of the switch device can be completely enclosed.

2. Description of the Related Art

A conventional switch device or switch indication device is applied to an electrical, electronic and automatic control system for an operator to operate the machine or power on/off the system.

For example, a conventional switch device discloses a part installation structure, in which a support body is connected with a pushbutton (an operation section) and a switch (a wire connection module). The support body is formed with a perforation for receiving the pushbutton. A ring-shaped rotary body is pivotally disposed on the perforation of the support body. A raised section is disposed on inner circumference of the rotary body. In addition, a lever protrudes from the outer circumference of the rotary body to extend into a protection section positioned on one side of the support body. The lever can drive the raised section of the rotary body to latch with a groove section formed on outer circumference of the pushbutton into a locked state, whereby the pushbutton is assembled with the support body. Also, the engagement section at the rear end of the lever is engaged with the engagement section in the protection section so as to locate the lever. The lever can be shifted to disengage the engagement section of the lever from the engagement section of the protection section. At this time, the lever will drive the raised section of the rotary body to move in a reverse direction to unlatch from the groove section of the pushbutton into an unlocked state to release the pushbutton. In addition, a holding claw is disposed on the bottom section of the support body for securely holding the switch, whereby the pushbutton can switch on/off the switch.

However, when the engagement section of the lever is engaged with or disengaged from the engagement section of the protection section, it is necessary to up and down shift the lever. When an external force is applied to the lever to up and down operate and shift the lever, the action force of the up and down shifting operation will be directly transmitted through the lever to the interior of the support body. As a result, the connection and operation relationship between the support body and the rotary body are apt to be affected. This will result in that during the locking/unlocking process, the switch device is easy to stick and can be hardly smoothly operated.

Moreover, when up and down shifting the lever, stress will concentrate on the junction between the swinging lever and the rotary body, which is not swung. This will directly affect the design and manufacturing condition of the rotary body and the lever. For example, in case the structure or material of the rotary body or the lever is designed to be softer, the free elasticity of the lever will be increased. This enables an operator to more easily operate the lever with less strength to engage the engagement section of the lever with the engagement section of the protection section or disengage the engagement section of the lever from the engagement section of the protection section. However, under such circumstance, the lever is easy to mis-touch by external force to lead to loosening or detachment of the engagement section of the lever from the engagement section of the protection section. Accordingly, the locking effect is poor. Reversely, in case the structural strength or the material strength of the rotary body and the lever are enhanced, the possibility of loosening or detachment of the lever due to mis-touch by external force is lowered. However, it will be more laborious to operate the lever to engage the engagement section of the lever with the engagement section of the protection section or disengage the engagement section of the lever from the engagement section of the protection section. Furthermore, in case the material or the structure of the lever is reinforced, the elastic deformability of the lever is often deteriorated at the same time. Under such circumstance, when shifting and operating the lever, the junction between the lever and the rotary body is easier to make the rotary body deflected along with the up and down shifting of the lever. As a result, during the locking/unlocking process, the switch device is easy to stick and can be hardly smoothly operated. In some more serious cases, the junction between the lever and the rotary body may break apart due to stress concentration.

In order to solve the above problem, another conventional switch device discloses a shift assembly structure of switch device. The shift assembly structure includes a connection seat for connecting with a main body and a wire connection module. The main body is equipped with an operation section, which can be a pushbutton or a rotary switch. Electrical contacts and wire connection components are mounted in the wire connection module for connecting with a conductive wire. The connection seat of the switch device is formed with an assembling hole for receiving the main body. The connection seat is formed with an arm and a mouth section formed on the arm. The mouth section serves to receive a restriction section. A shift body is pivotally disposed on the connection seat. The shift body is formed with a ridge section and a push/press section. The shift body can drive the ridge section to directly elastically pass over the restriction section without up and down shifting the arm. Accordingly, the ridge section can be easily restricted by the restriction section. The insertion block of the shift body is latched with the channel of the main body in a locked state. In the locked state, in case the push/press section is pressed, the restriction section is pushed and deformed, whereby the ridge section is released from the restriction of the restriction section. At this time, the insertion block of the shift body can be driven to move backward to unlatch from the channel of the main body into an unlocked state to release the main body. In addition, multiple latch sections are disposed on the bottom section of the connection seat for latching with multiple side by side arranged wire connection modules. The operation section serves to drive the wire connection component to control the electrical contact into an open-circuit state or a closed-circuit state.

The above locking structure of switch device employs the restriction section to lock the ridge section. Such locking structure has a shortcoming that when unlocked, it is necessary to push both the push/press section and the restriction section to move and deform these two components. Obviously, it is more strength-consuming to perform the operation. Moreover, the arm of the connection seat is formed with the mouth section for the mobility of the restriction section. This deteriorates the enclosure of the entire structure of the switch device.

It is therefore tried by the applicant to provide a locking structure of switch device to improve the shortcomings existing in the conventional locking structure of switch device.

SUMMARY OF THE INVENTION

It is therefore a primary object of the present invention to provide a locking structure of switch device, and more particularly to a locking structure. The locking structure of the switch device can be operated with less strength. In addition, the entire structure of the locking structure of the switch device can be completely enclosed.

To achieve the above and other objects, the locking structure of switch device of the present invention includes a connection seat and a shift body. The connection seat is formed with a main body assembling hole for receiving an operation section main body. An arm is disposed on the connection seat. A restriction section is formed on the arm. The shift body is assembled on the connection seat. The shift body is movable between a first position and a second position. The shift body has a shift section. The shift section is aligned with the arm in the second position. A lever member is disposed on the shift section. Two ends of the lever member are respectively formed with a ridge section and a push/press section. When the shift body moves from the first position to the second position, the ridge section is permitted to directly elastically pass over the restriction section to be restricted by the restriction section into a locked state. In the locked state, an operator simply needs to push the push/press section of the lever member to drive the ridge section by way of leverage to backward pass over the restriction section into the unlocked state. In contrast, when unlocking the locking structure of the conventional switch device, it is necessary to push both the two components and deform the two components at the same time. In comparison with the conventional locking structure, obviously, the locking structure of the switch device of the present invention can be operated with less strength. Moreover, in operation, the arm of the connection seat is free from the mouth section of the conventional switch device for achieving the locking/unlocking effect. Therefore, the entire structure is more completely enclosed.

In the above locking structure of switch device, the arm protrudes from one side of an upper section of the connection seat. A sidewall is disposed on one side of the arm. Two sides of the restriction section are respectively formed with a sloped section and a stop wall facing the sidewall. An insertion cavity is defined between the stop wall and the sidewall.

In the above locking structure of switch device, a support section is formed between a start end of the sloped section and the stop wall. When the ridge section of the lever member passes over the restriction section, the ridge section is stopped by the stop wall or elastically abuts against the support section.

In the above locking structure of switch device, an insertion cavity is defined between the stop wall and the sidewall for stopping and latching with the ridge section.

In the above locking structure of switch device, a fulcrum section is disposed at the middle of the lever member. The fulcrum section is connected with the shift section. With the fulcrum section serving as a fulcrum, the push/press section and the ridge section respectively form two ends of a leverage structure.

In the above locking structure of switch device, the shift section is formed with a mouth section for receiving the lever member. The fulcrum section is connected with the mouth section, whereby the ridge section and the push/press section respectively have an elastic motional range.

In the above locking structure of switch device, the shift body is assembled with the upper section of the connection seat. The shift body includes an annular section. The shift section protrudes from the annular section. The annular section is formed with a perforation and multiple insertion blocks formed on the perforation.

In the above locking structure of switch device, a latch section is disposed on a bottom section of the connection seat.

The present invention can be best understood through the following description and accompanying drawings, wherein:

DETAILED DESCRIPTION OF THE PREFERRED EMBODIMENTS

Figure 1:
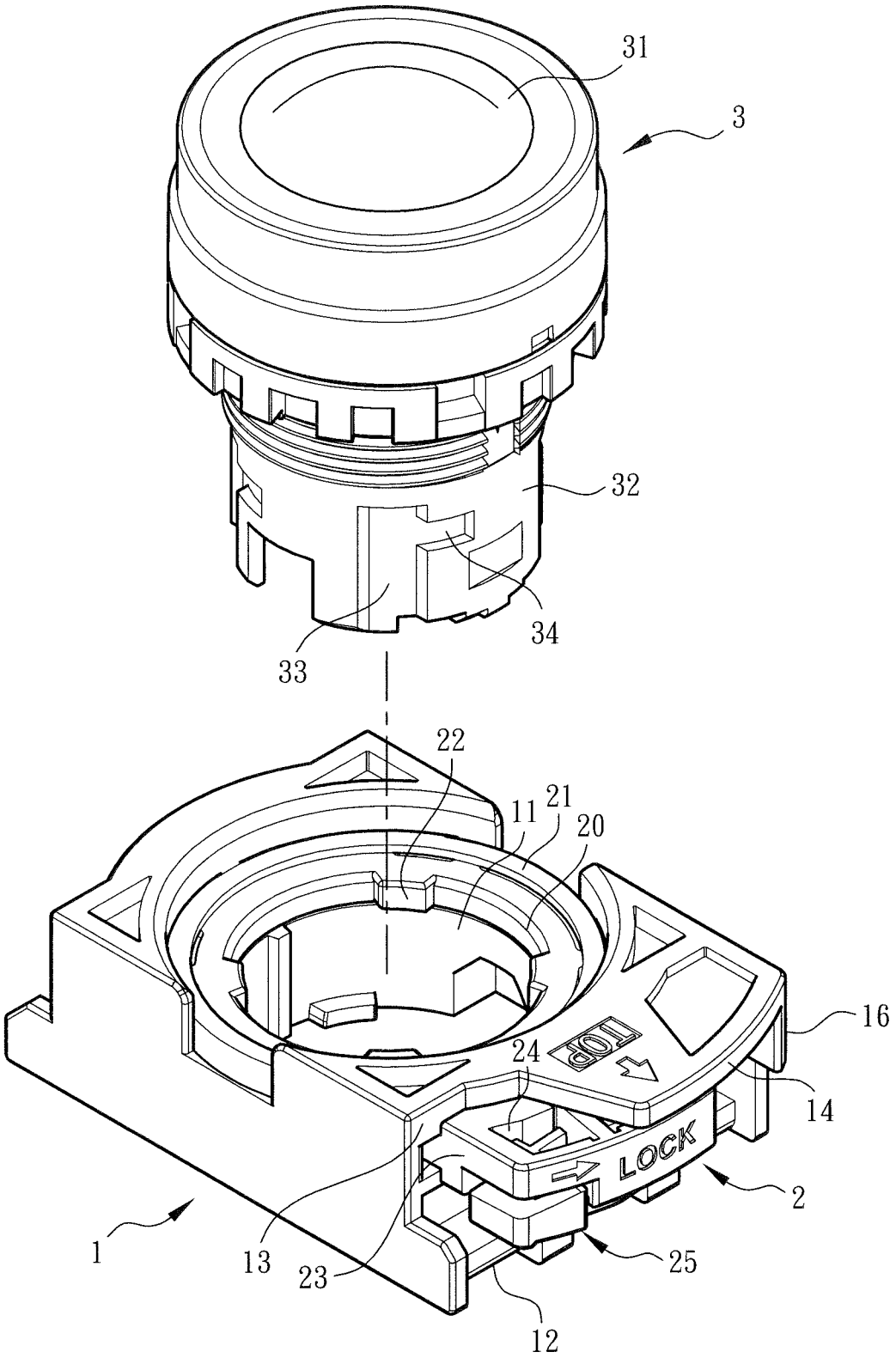
FIG. 1 is a perspective exploded view of the connection seat and the main body of the present invention.
Figure 2:
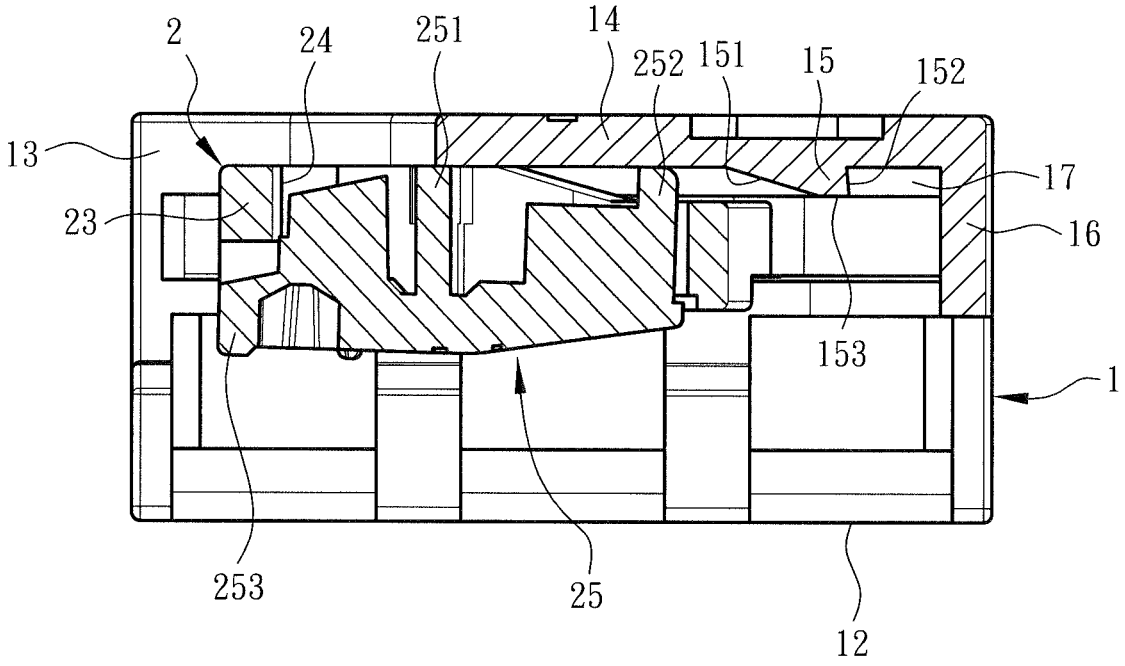
FIG. 2 is a sectional assembled view according to FIG. 1, showing the restriction section of the connection seat and the lever member of the present invention.
Figure 3:
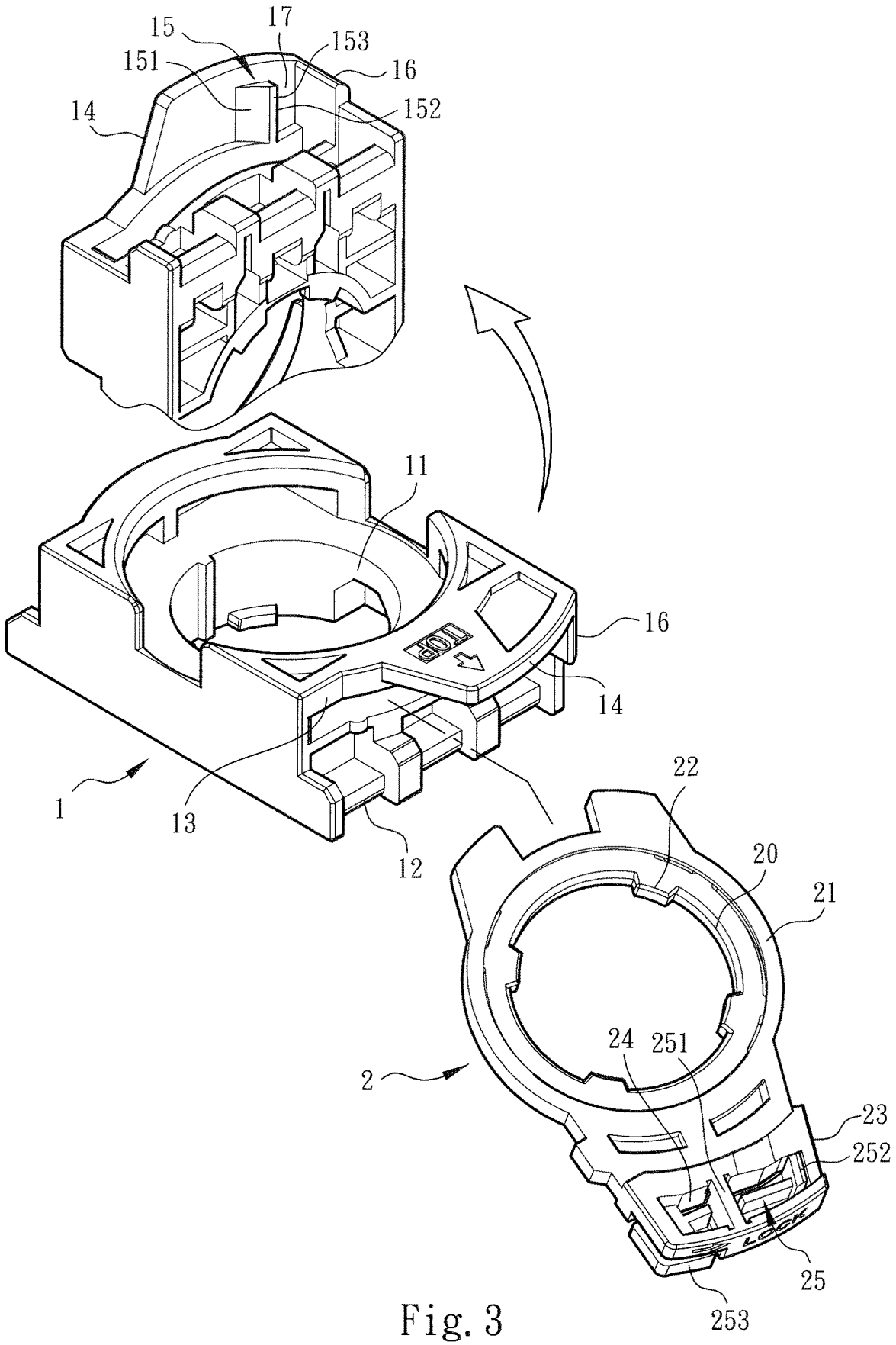
FIG. 3 is a perspective partial cut-away view of the connection seat of the present invention showing internal details, according to FIG. 1.

Please refer to FIGS. 1 to 3. The locking structure of switch device of the present invention includes a connection seat 1 and a shift body 2 assembled with the connection seat 1. The connection seat 1 is formed with a main body assembling hole 11. The shift body 2 is formed with a perforation 20 in communication with and in alignment with the main body assembling hole 11. The main body assembling hole 11 and the perforation 20 serve to together receive an operation section main body 3 to assemble the main body 3 with the connection seat 1. An operation section 31 is received and disposed in the main body 3 for an operator to press or rotate so as to control the switch device into a closed-circuit state or an open-circuit state. The main body 3 has a shaft section 32 and a channel 33 formed on the shaft section 32. One side of the channel 33 communicates with an end channel 34. A latch section 12 is disposed on the bottom section of the connection seat 1 for latching with multiple side by side arranged wire connection modules. (The wire connection modules pertain to prior art and are thus not shown). Electrical contacts and wire connection components are mounted in the wire connection modules for connecting with external conductive wires. Via the operation section 31, an operator can drive the wire connection components to control the electrical contacts into an open-circuit state or a closed-circuit state.

In this embodiment, an arm 14 protrudes from one side of an upper section 13 (or top section) of the connection seat 1. A restriction section 15 is formed on the arm 14. A sidewall 16 is disposed on one side of bottom face of the arm 14. The restriction section 15 protrudes from the bottom face of the arm 14 to the bottom section (or the latch section 12) of the connection seat 1. Two sides of the restriction section 15 are respectively formed with a sloped section 151 and a stop wall 152 facing the sidewall 16. An insertion cavity 17 is defined between the stop wall and the sidewall. A support section 153 is formed between a start end of the sloped section 151 and the stop wall 152.

Figure 4:
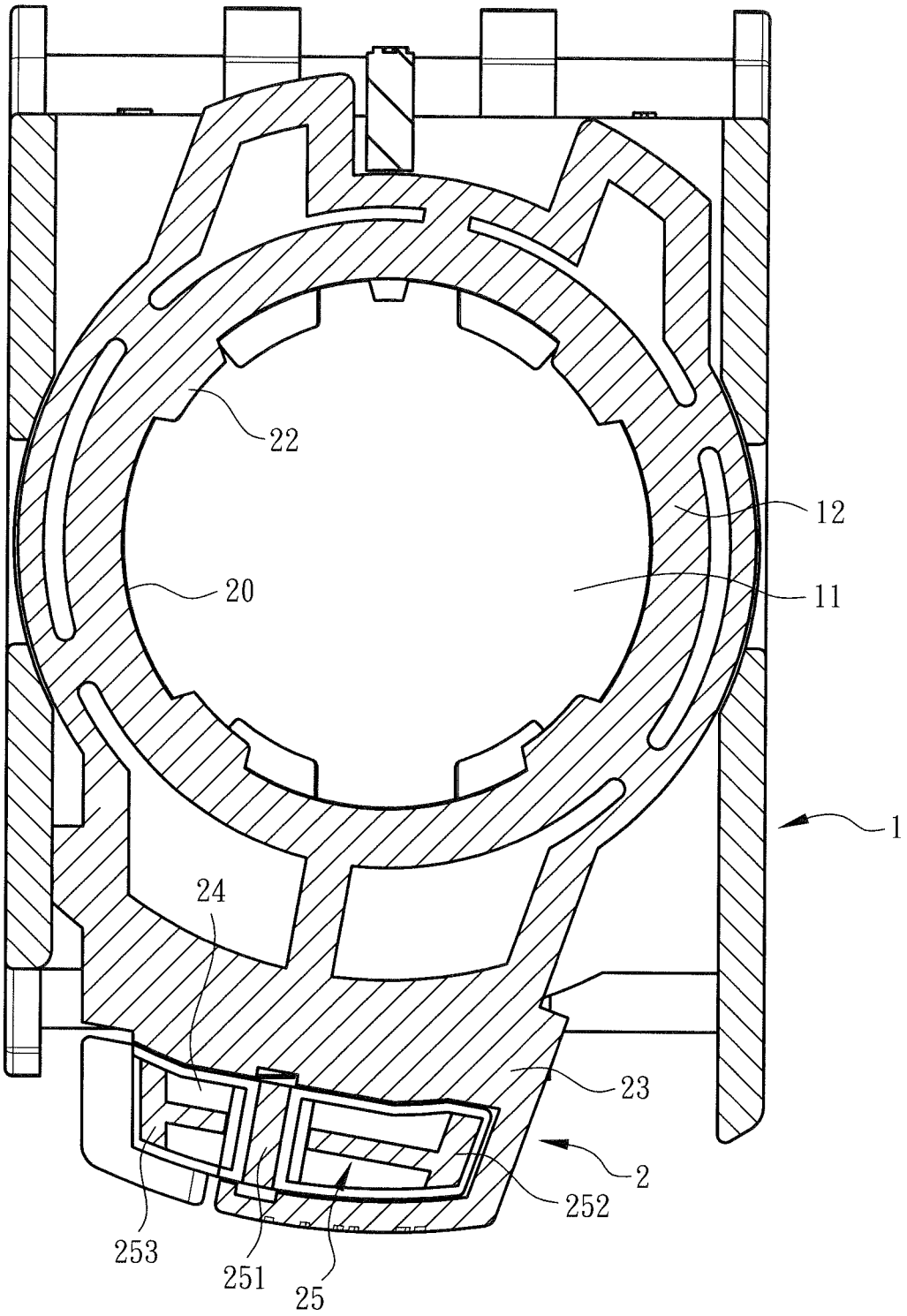
FIG. 4 is a sectional view according to FIG. 1, showing the connection seat and the shift body of the present invention.

Please refer to FIGS. 1, 3 and 4. The shift body 2 is assembled with the upper section 13 of the connection seat 1. The shift body 2 includes an annular section 21, a shift section 23 protruding from outer circumferential wall of the annular section 21 and a mouth section 24 formed on the shift section 23. The annular section 21 is formed with a perforation 20 and multiple insertion blocks 22 formed on inner wall of the perforation 20. A lever member 25 is received in the mouth section 24.

As shown in FIGS. 2 and 3, in a preferred embodiment, a fulcrum section 251 is disposed at the middle of the lever member 25. The fulcrum section 251 is connected with the inner wall of the central portion of the mouth section 24. Two ends of the lever member 25 are respectively formed with a ridge section 252 and a push/press section 253. With the fulcrum section 251 serving as the leverage fulcrum, the push/press section 253 forms a leverage structure relative to the ridge section 252. In this embodiment, the shift section 23, the mouth section 24 and the lever member 25 of the shift body 2 can be integrally made of plastic material. Accordingly, the fulcrum section 251 has elasticity and is flexible to serve as the swinging fulcrum of the lever member 25. Therefore, with the fulcrum section 251 serving as the leverage fulcrum, the push/press section 253 and the ridge section 252 at two ends of the lever member 25 can relatively swing in reverse directions. The ridge section 252 and the push/press section 253 respectively have an elastic motional range. Accordingly, when an operator presses the push/press section 253, the lever member 25 will drive the ridge section 252 to swing in a reverse direction by way of leverage with the fulcrum section 251 serving as the leverage fulcrum.

As shown in FIGS. 1 and 2, when the shift body 2 is assembled with the connection seat 1 with the shift section 23 misaligned from the arm 14, the channel 33 of the operation section main body 3 is permitted to pass through the insertion block 22 in the perforation 20 of the annular section 21, whereby the main body 3 can be assembled with the connection seat 1. At this time, the shift body 2 is positioned in an unlocked position (or uninstallation position). The unlocked position is defined as a first position.

Figure 5:
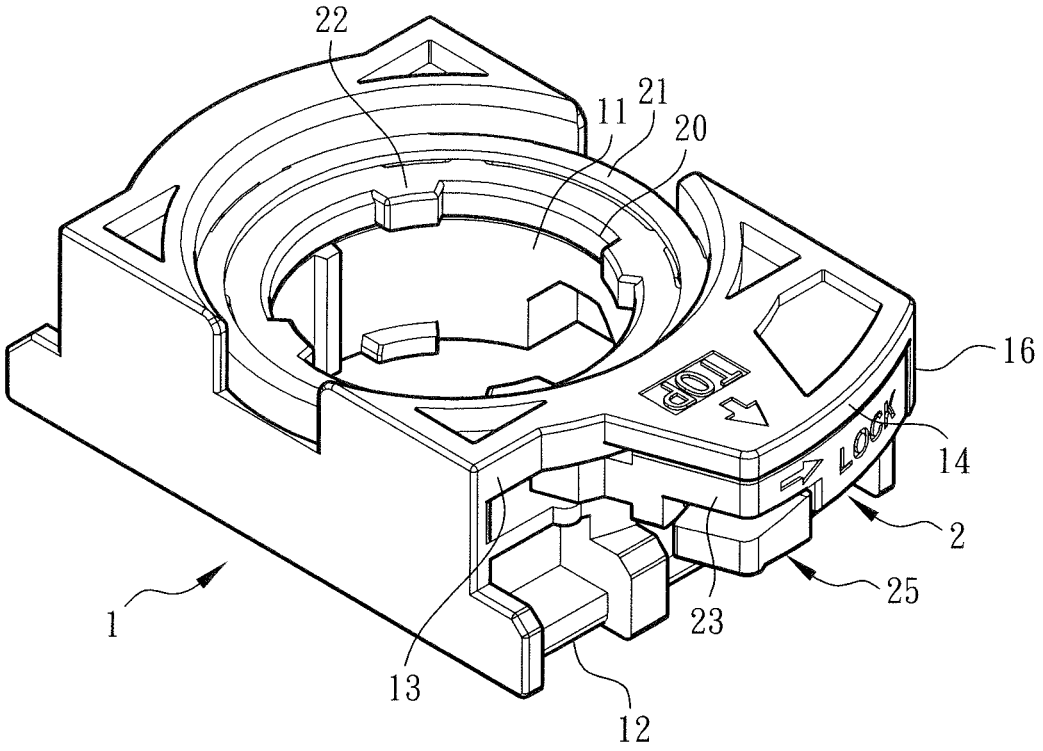
FIG. 5 is a perspective view according to FIG. 1, showing the use of the connection seat of the present invention.
Figure 6:
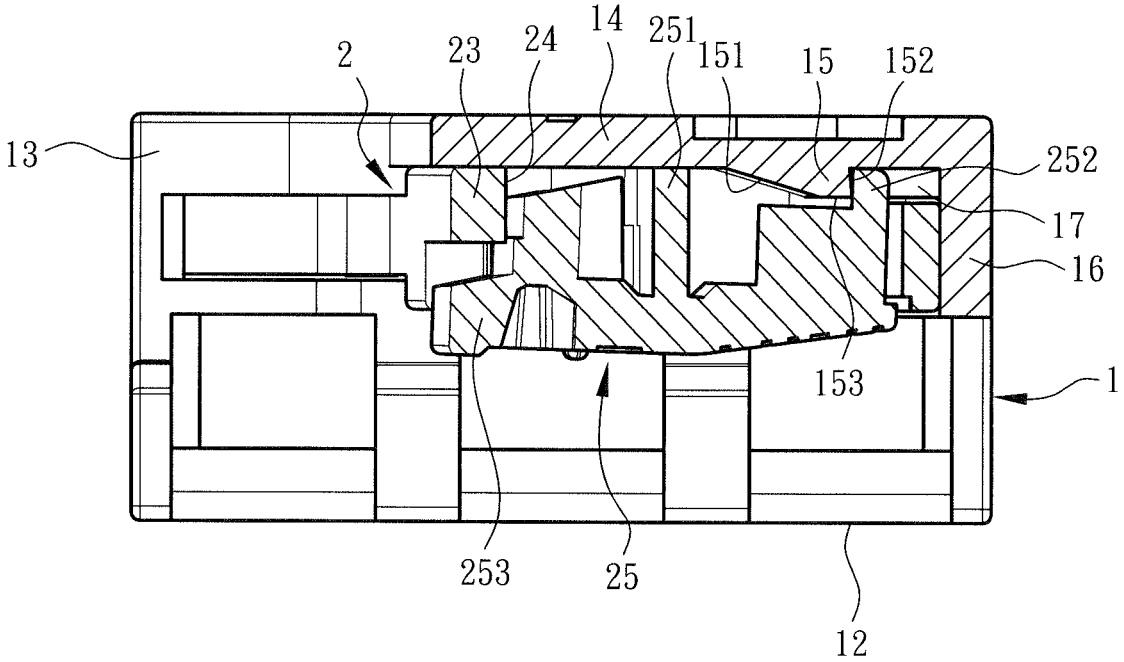
FIG. 6 is a sectional view according to FIG. 5, showing the restriction section and the lever member of the present invention.

As shown in FIGS. 5 and 6, when the shift section 23 of the shift body 2 is moved to a position near the sidewall 16 of the arm 14 and the shift section 23 is aligned with the arm 14, the insertion block 22 of the annular section 21 is driven to move from the channel 33 of the main body 2 into the end channel 34 (with reference to FIG. 1). At this time, the shift body 2 is positioned in a locked position (or installation position). The locked position is defined as a second position.

Please refer to FIGS. 1, 2, 5 and 6. When an operator operates the shift section 23 to move from the first position to the second position, the ridge section 252 slides along the sloped section 151 and the support section 153 to make the lever member 25 elastically swing the ridge section 252 in the protruding direction of the restriction section 15 (or in a direction to the bottom section of the connection seat 1). Accordingly, the ridge section 252 directly elastically passes over the protruding section (the support section 153) of the restriction section 15 to elastically latch into the insertion cavity 17 defined between the stop wall 152 and the sidewall 16. Therefore, one side of the ridge section 252 is automatically elastically backward stopped by the stop wall 152, whereby the shift section 23 cannot be operated in the unlocked direction. The edge of the shift section 23 positioned on the other side of the ridge section 252 is also stopped by the sidewall 16, whereby the ridge section 252 is restricted within the insertion cavity 17 in a locked state.

Figure 7:
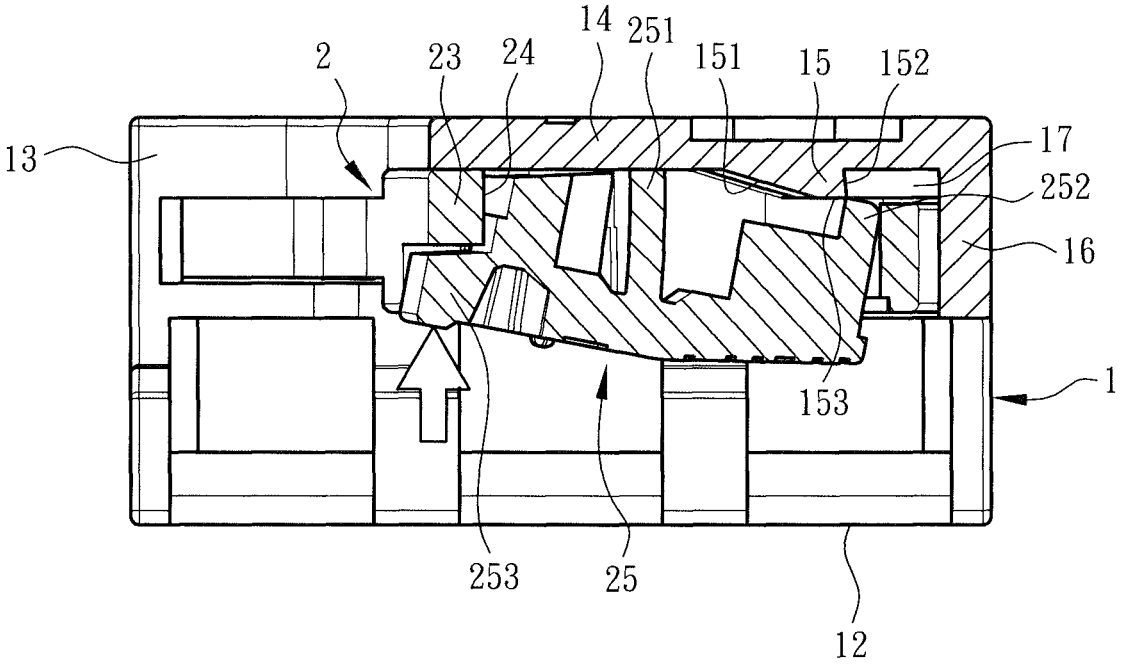
FIG. 7 is a sectional view according to FIG. 6, showing an unlocking use of the present invention.

Please refer to FIG. 7. In the locked state, when an operator presses the push/press section 253 in a direction to the arm 14, the push/press section 253 is urged to drive the ridge section 252 to elastically swing in the protruding direction of the restriction section 15 (or in the direction to the bottom section of the connection seat 1) with the fulcrum section 251 serving as the fulcrum. Accordingly, the ridge section 252 is forced to pass over the restriction section 15 to unlatch from the insertion cavity 17. At this time, the shift section 23 can be pushed from the second position to the first position (as shown in FIGS. 1 and 2) into an unlocked state (or uninstalled state). Also, the shift body 2 drives the insertion block 22 to move from the end channel 34 back to the channel 33 to unlatch the channel 33 of the main body 1 from the insertion block 22. Under such circumstance, the main body 3 can be detached from the connection seat 1.

It should be noted that when the ridge section 252 elastically swings in the protruding direction of the restriction section 15 within the insertion cavity 17 (as shown in FIG. 7), the ridge section 252 swings in an arched path with the fulcrum section 251 serving as the fulcrum. Therefore, when the ridge section 252 gradually moves in the protruding direction of the restriction section 15, there is a trend to urge the ridge section 252 to gradually push/press the stop wall 152. At this time, due to the stop of the stop wall 152 in the reverse direction, the ridge section 252 will be slightly elastically bent in a direction to the sidewall 16. In the instant of just passing over the protruding height of the stop wall 152, the ridge section 252 will immediately release the elastic force to elastically move toward the sloped section 151 of the restriction section 15 (or the fulcrum section 251). Therefore, the ridge section 252 can pass over the stop wall 152 to elastically abut against the support section 153. Accordingly, when the action force for pressing the push/press section 253 is released, the ridge section 252 is effectively prevented from again elastically latching into the insertion cavity 17 defined between the stop wall 152 and the sidewall 16. This makes it easy to operate the shift section 23 from the second position back to the first position.

By means of the structures of the restriction section 15 of the connection seat 1 and the lever member 25 of the shift body 2, an operator only needs to push one single component, that is, the lever member 25, for completing the unlocking operation of the locking structure. In contrast, when unlocking the locking structure of the conventional switch device, it is necessary to push two components and deform the two components at the same time. In comparison with the conventional locking structure, obviously, the locking structure of the switch device of the present invention can be operated with less strength. Moreover, in operation, the arm 14 of the connection seat 1 is free from the mouth section of the conventional switch device for achieving the locking/unlocking effect. Therefore, the entire structure is more completely enclosed. Accordingly, the present invention improves the shortcomings of the conventional switch device that when assembling/disassembling the main body, the operation is strength-consuming and the entire structure can be hardly completely enclosed.

Besides, the fulcrum section 251 of the lever member 25 is disposed between the push/press section 253 and the ridge section 252. In a preferred embodiment, the fulcrum section 251 can be alternatively disposed on the lever member 25 in a position in adjacency to the ridge section 252. In this case, the distance between the push/press section 253 and the fulcrum section 251 is larger than the distance between the ridge section 252 and the fulcrum section 251. This can enhance the strength-saving effect in operation of the lever member 25.

In a modified embodiment, the fulcrum section 251 can be alternatively disposed on the lever member 25 in a position in adjacency to the push/press section 253. In this case, the distance between the push/press section 253 and the fulcrum section 251 is smaller than the distance between the ridge section 252 and the fulcrum section 251. This can increase the swinging angle of the ridge section 252 driven by the lever member 25 so as to increase the raising length of the ridge section 252 and the depth of the insertion cavity 17. Under such circumstance, the security of the ridge section 252 latched in the insertion cavity 17 is enhanced.

The above embodiments are only used to illustrate the present invention, not intended to limit the scope thereof. Many modifications of the above embodiments can be made without departing from the spirit of the present invention.

What is claimed is:

1. A locking structure of switch device comprising:

a connection seat formed with a main body assembling hole, an arm being disposed on the connection seat, a restriction section being formed on the arm; and a shift body assembled on the connection seat, the shift body being movable between a first position and a second position, the shift body having a shift section, the shift section being aligned with the arm in the second position, a lever member being disposed on the shift section, a first end of the lever member being formed with a ridge section, a second end of the lever member opposite the first end being formed with a push/press section, wherein:

when the shift body moves from the first position to the second position, the ridge section of the lever member is deflected elastically to pass and engage the restriction section to be locked thereby, and when the push/press section of the lever member is pressed, the ridge section of the lever member is driven to disengage from the restriction section to be unlocked therefrom.

2. The locking structure of switch device as claimed in claim 1, wherein a latch section is disposed on a bottom section of the connection seat.

3. The locking structure of switch device as claimed in claim 1, wherein the shift body is assembled with the upper section of the connection seat, the shift body including an annular section, the shift section protruding from the annular section, the annular section being formed with a perforation and multiple insertion blocks formed on the perforation.

4. The locking structure of switch device as claimed in claim 3, wherein a latch section is disposed on a bottom section of the connection seat.

5. The locking structure of switch device as claimed in claim 1, wherein a fulcrum section is disposed at the middle of the lever member, the fulcrum section being connected with the shift section, with the fulcrum section serving as a fulcrum, the push/press section and the ridge section respectively forming opposite ends of a leverage structure.

6. The locking structure of switch device as claimed in claim 5, wherein the shift section is formed with a mouth section for receiving the lever member, the fulcrum section being connected with the mouth section, whereby the ridge section and the push/press section respectively have an elastic motional range.

7. The locking structure of switch device as claimed in claim 5, wherein the shift body is assembled with the upper section of the connection seat, the shift body including an annular section, the shift section protruding from the annular section, the annular section being formed with a perforation and multiple insertion blocks formed on the perforation.

8. The locking structure of switch device as claimed in claim 5, wherein a latch section is disposed on a bottom section of the connection seat.

9. A locking structure of switch device comprising:

a connection seat formed with a main body assembling hole, an arm protruding from one side of an upper section of the connection seat, a sidewall being disposed on one side of the arm, a restriction section being formed on the arm, the restriction section being immovable when the ridge section transitions between a locked state and an unlocked state, two sides of the restriction section being respectively formed with a sloped section and a stop wall facing the sidewall, an insertion cavity being defined between the stop wall and the sidewall; and a shift body assembled on the connection seat, the shift body being movable between a first position and a second position, the shift body having a shift section, the shift section being aligned with the arm in the second position, a lever member being disposed on the shift section, two ends of the lever member being respectively formed with a ridge section and a push/press section, wherein:

when the shift body moves from the first position to the second position, the ridge section is permitted to directly elastically pass over the restriction section to be restricted by the restriction section into the locked state, and when the push/press section is pressed, the ridge section is driven by way of leverage to backward pass over the restriction section into the unlocked state.

10. The locking structure of switch device as claimed in claim 9, wherein a latch section is disposed on a bottom section of the connection seat.

11. The locking structure of switch device as claimed in claim 9, wherein the shift body is assembled with the upper section of the connection seat, the shift body including an annular section, the shift section protruding from the annular section, the annular section being formed with a perforation and multiple insertion blocks formed on the perforation.

12. The locking structure of switch device as claimed in claim 9, wherein a fulcrum section is disposed at the middle of the lever member, the fulcrum section being connected with the shift section, with the fulcrum section serving as a fulcrum, the push/press section and the ridge section respectively forming two ends of a leverage structure.

13. The locking structure of switch device as claimed in claim 12, wherein the shift section is formed with a mouth section for receiving the lever member, the fulcrum section being connected with the mouth section, whereby the ridge section and the push/press section respectively have an elastic motional range.

14. The locking structure of switch device as claimed in claim 12, wherein the shift body is assembled with the upper section of the connection seat, the shift body including an annular section, the shift section protruding from the annular section, the annular section being formed with a perforation and multiple insertion blocks formed on the perforation.

15. The locking structure of switch device as claimed in claim 9, wherein an insertion cavity is defined between the stop wall and the sidewall for stopping and latching with the ridge section.

16. The locking structure of switch device as claimed in claim 15, wherein the shift body is assembled with the upper section of the connection seat, the shift body including an annular section, the shift section protruding from the annular section, the annular section being formed with a perforation and multiple insertion blocks formed on the perforation.

17. The locking structure of switch device as claimed in claim 15, wherein a latch section is disposed on a bottom section of the connection seat.

18. The locking structure of switch device as claimed in claim 15, wherein a fulcrum section is disposed at the middle of the lever member, the fulcrum section being connected with the shift section, with the fulcrum section serving as a fulcrum, the push/press section and the ridge section respectively forming two ends of a leverage structure.

19. The locking structure of switch device as claimed in claim 18, wherein the shift section is formed with a mouth section for receiving the lever member, the fulcrum section being connected with the mouth section, whereby the ridge section and the push/press section respectively have an elastic motional range.

20. The locking structure of switch device as claimed in claim 9, wherein a support section is formed between a start end of the sloped section and the stop wall.

21. The locking structure of switch device as claimed in claim 20, wherein the shift body is assembled with the upper section of the connection seat, the shift body including an annular section, the shift section protruding from the annular section, the annular section being formed with a perforation and multiple insertion blocks formed on the perforation.

22. The locking structure of switch device as claimed in claim 20, wherein a latch section is disposed on a bottom section of the connection seat.

23. The locking structure of switch device as claimed in claim 20, wherein a fulcrum section is disposed at the middle of the lever member, the fulcrum section being connected with the shift section, with the fulcrum section serving as a fulcrum, the push/press section and the ridge section respectively forming two ends of a leverage structure.

24. The locking structure of switch device as claimed in claim 23, wherein the shift section is formed with a mouth section for receiving the lever member, the fulcrum section being connected with the mouth section, whereby the ridge section and the push/press section respectively have an elastic motional range.

25. The locking structure of switch device as claimed in claim 23, wherein the shift body is assembled with the upper section of the connection seat, the shift body including an annular section, the shift section protruding from the annular section, the annular section being formed with a perforation and multiple insertion blocks formed on the perforation.

26. The locking structure of switch device as claimed in claim 20, wherein an insertion cavity is defined between the stop wall and the sidewall for stopping and latching with the ridge section.

27. The locking structure of switch device as claimed in claim 26, wherein the shift body is assembled with the upper section of the connection seat, the shift body including an annular section, the shift section protruding from the annular section, the annular section being formed with a perforation and multiple insertion blocks formed on the perforation.

28. The locking structure of switch device as claimed in claim 26, wherein a fulcrum section is disposed at the middle of the lever member, the fulcrum section being connected with the shift section, with the fulcrum section serving as a fulcrum, the push/press section and the ridge section respectively forming two ends of a leverage structure.

29. The locking structure of switch device as claimed in claim 28, wherein the shift section is formed with a mouth section for receiving the lever member, the fulcrum section being connected with the mouth section, whereby the ridge section and the push/press section respectively have an elastic motional range.

* * * * *